US007690923B2

(12) United States Patent
Horchler et al.

(10) Patent No.: US 7,690,923 B2
(45) Date of Patent: Apr. 6, 2010

(54) TWO-SIDED FPC-TO-PCB COMPRESSION CONNECTOR

(75) Inventors: David C. Horchler, Millersburg, PA (US); Robert E. Marshall, Elizabethtown, PA (US)

(73) Assignee: FCI Americas Technology, Inc., Carson City, NV (US)

( * ) Notice: Subject to any disclaimer, the term of this patent is extended or adjusted under 35 U.S.C. 154(b) by 93 days.

(21) Appl. No.: 12/030,687

(22) Filed: Feb. 13, 2008

(65) Prior Publication Data

US 2009/0203246 A1 Aug. 13, 2009

(51) Int. Cl.
*H01R 12/00* (2006.01)

(52) U.S. Cl. ..... 439/67

(58) Field of Classification Search ..... 439/67, 439/66, 862, 165, 260, 493, 495, 498
See application file for complete search history.

(56) References Cited

U.S. PATENT DOCUMENTS

| | | | | |
|---|---|---|---|---|
| 3,629,787 | A | 12/1971 | Wilson | |
| 4,050,755 | A | 9/1977 | Hasircoglu | |
| 4,509,811 | A | 4/1985 | Amano et al. | |
| 4,639,063 | A | 1/1987 | Mueller | |
| 4,640,562 | A | 2/1987 | Shoemaker | |
| 4,695,108 | A | 9/1987 | Ichitsubo | |
| 4,871,315 | A | 10/1989 | Noschese | |
| 4,897,041 | A | 1/1990 | Heiney et al. | |
| 4,936,792 | A | 6/1990 | Onoue et al. | |
| 4,998,886 | A | 3/1991 | Werner | |
| 5,139,427 | A | 8/1992 | Boyd et al. | |
| 5,498,166 | A | 3/1996 | Rothenberger | |
| 5,749,752 | A * | 5/1998 | Kashiyama et al. | 439/733.1 |
| 5,921,785 | A * | 7/1999 | Ii | 439/60 |
| 6,000,950 | A | 12/1999 | Kajinuma | |
| 6,672,879 | B2 * | 1/2004 | Neidich et al. | 439/67 |
| 6,754,041 | B2 | 6/2004 | Hong et al. | |
| 6,790,073 | B2 * | 9/2004 | Wu | 439/495 |
| 6,808,412 | B2 | 10/2004 | Ishii | |
| 6,869,291 | B2 * | 3/2005 | Norland et al. | 439/67 |
| 6,893,269 | B2 | 5/2005 | Matsunaga | |

(Continued)

OTHER PUBLICATIONS

PCT Search Report and Written Opinion dated Jul. 16, 2009, for PCT/US2009/033161 filed Feb. 5, 2009.

*Primary Examiner*—Tho D Ta
(74) *Attorney, Agent, or Firm*—Woodcock Washburn LLP

(57) ABSTRACT

An electrical connector with a flexible printed circuit (FPC) received may carry electrical signals between the FPC and a substrate. Latching mechanisms may serve to position the cap on the body such that the positions facilitate the insertion and retention of the FPC in the cap for a good electrical connection. The FPC may be received loosely in the cap when the cap is in a first position on the body. When the cap is depressed into a second position, the FPC may be compressed between the cap and the body. Mating ends of the contacts may electrically connect to exposed conductive elements of the FPC. Mounting ends of the contacts in the contact housing may electrically connect to the conductive elements on a substrate. If the contacts are compression contacts, the terminals of the contacts may deflect or compress when a force is exerted upon them. The electrical connector may have a sealing surface that is adapted to provide suitable compression against an FPC received by the electrical connector so as to keep out gases or fluids.

21 Claims, 13 Drawing Sheets

U.S. PATENT DOCUMENTS 6,896,561 B2 * 5/2005 Lai ..... 439/862
6,960,094 B2 * 11/2005 Tomonari et al. ..... 439/329
6,980,391 B1 12/2005 Haro
7,011,555 B2 * 3/2006 Pan ..... 439/862
7,037,113 B2 5/2006 Soh
7,048,549 B1 5/2006 Swain
7,083,455 B1 8/2006 Miura et al.
7,112,089 B1 9/2006 Liu et al.
7,189,090 B2 3/2007 Aizawa et al.
7,351,117 B1 4/2008 Mostoller et al.
7,476,106 B1 * 1/2009 Wu et al. ..... 439/67
2005/0250353 A1 11/2005 Soh
2006/0094284 A1 5/2006 Aizawa et al.
2006/0228933 A1 10/2006 Liu et al.

* cited by examiner

TWO-SIDED FPC-TO-PCB COMPRESSION CONNECTOR

BACKGROUND

AN FPC-to-PCB connector carries electrical signals from a flexible printed circuit ("FPC)" to a rigid substrate, such as a printed circuit board ("PCB"). Typically, an electrical connector that is designed to receive an FPC may be attached or soldered to a rigid PCB or secured in a computer chassis before the FPC is secured to the electrical connector. Then, the FPC may be secured to the electrical connector. The electrical connector may have a mechanism for receiving the FPC, such as a hinged lid, for example, which closes down on the FPC and screws into the PCB or chassis to hold the FPC in place.

It may be desirable to handle an electrical connector with the FPC received prior to attachment to the printed circuit board, during manufacture, for example. The FPC and electrical connector are not usually secured as a standalone unit prior to attachment of the electrical connector to the printed circuit board. Typically, the electrical connector is secured to a rigid structure first before the FPC is attached thereto. Otherwise, the FPC may slip out or uncouple from the electrical connector. Simply holding the FPC and electrical connector together while attaching the assembly to a printed circuit board may not ensure a good electrical or mechanical connection. Without a mechanism in place to secure the components together, the FPC often may become uncoupled from the electrical connector.

Often, the space where electrical connectors are mounted is limited, such as the limited space in a computer chassis. Consequently, coupling the FPC to the electrical connector after the electrical connector has been mounted may be difficult due to the space constraints. A secure electrical and mechanical connection may not be achieved. Furthermore, electrical connectors may be used in spaces that are subject to gases or fluids, where contact of the electrical connector with such substances is undesirable. The electrical connector may include a sealing surface that may seal with another surface, thereby creating a barrier to the undesirable substances. Often, when an FPC is coupled to the electrical connector, the FPC extends from the electrical connector such that a portion of the FPC abuts the sealing surface. The FPC may interfere with the sealing surface such that the seal between the connector and another surface is not uniform.

It would be desirable to have a method of securing an FPC to an electrical connector to create a good electrical and mechanical connection. It would be desirable to have an electrical connector that can receive an FPC that does not uncouple from the electrical connector prior to attachment of the electrical connector to a rigid structure. Such a standalone unit would allow handling of the electrical connector with the FPC secured therein. It would also be desirable to have a better seal between an electrical connector that receives an FPC and another surface, so as to keep out gases or fluids.

SUMMARY

An electrical connector may be assembled via latching mechanisms, providing a method of securely receiving an FPC. The FPC may be received by the electrical connector prior to attachment of the electrical connector to a rigid structure. The resulting "FPC assembly" may then be handled as a standalone unit, wherein the FPC does not slide out or uncouple from the electrical connector without some force.

Aside from providing a good electrical connection, the scheme disclosed for interconnecting an FPC to a printed circuit board provides for a good mechanical connection prior to attachment of the electrical connector to a rigid structure. Typically, the assembly process includes attaching an electrical connector to a rigid structure and then coupling the FPC to the electrical connector. Disclosed herein is a process of assembly that includes securing the FPC to the electrical connector prior to attaching the electrical connector to a rigid structure.

Such an electrical connector may include a cap and a contact housing that houses a plurality of electrical contacts. The cap may be depressed on the contact housing into a first position. An FPC may be loosely inserted into an opening in the cap while the electrical connector is in this first position. The cap may be depressed on the contact housing into a second position. As the cap is depressed into the second position, electrically conductive pads on the FPC may engage the contacts in the contact housing. The second position may provide force between the FPC and the contacts that are housed in the contact housing. The force of the second position may secure the FPC in the electrical connector through the rest of the assembly process. The electrical connector may use a mechanism to keep the cap in the positions, such as latching or locking mechanisms.

The electrical connector may have a sealing surface that compresses against another surface, such as a base plate or a substrate, for example. A portion of the FPC extending from the electrical connector may abut a sealing surface on the electrical connector, such as a seal on the underside of the cap. The sealing surface may be adapted to compress between the cap and another surface so as to fill in gaps that may result due to the portion of the FPC that abuts the seal.

The contacts housed in the contact housing of an electrical connector such as that described herein may have a suitable geometry for compression. The upper terminal ends of the contacts may extend from the contact housing. When the cap is depressed into the second position, the contacts may compress or deflect against the cap or, if inserted into the cap, the FPC. The contacts may include a mechanism to secure the contacts in the contact housing. The compression or compression of the contacts as the cap is depressed may further secure the contacts in the contact housing.

The lower terminal ends of the contacts may extend from the contact housing in a direction different than the upper terminal ends. The lower terminal ends may correspond to a rigid structure, such as a rigid printed circuit board. As the cap is depressed on the contact housing, the lower terminal ends may also compress or deflect to be suitably biased against conductive elements of the rigid structure.

A contact housing including such contacts is also disclosed.

BRIEF DESCRIPTION OF THE DRAWINGS

FIG. 7B shows the base plate in cross-section. FIG. 7C shows the electrical connector, base plate, and substrate in cross-section.

FIG. 9B shows the electrical connector with a disk-shaped hinged cap, the connector mounted on a substrate with a base plate between, with the base plate shown in cross-section.

DETAILED DESCRIPTION OF ILLUSTRATIVE EMBODIMENTS

Figure 1:
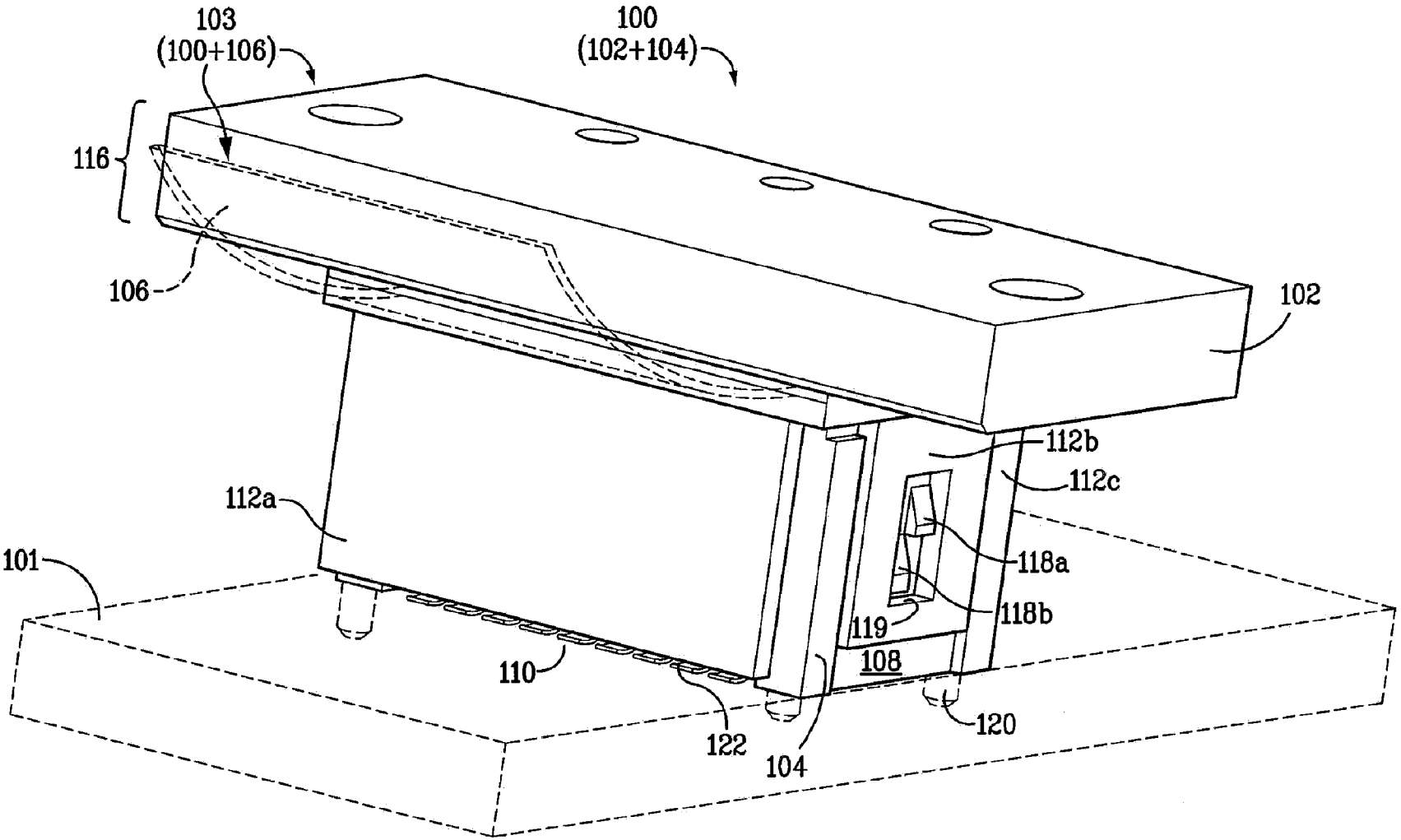
FIG. 1 depicts a perspective view of an example flexible printed circuit assembly mounted on a substrate.

FIG. 1 depicts an electrical connector 100 mounted on a substrate 101 with a flexible printed circuit 106 ("FPC") received therein. The electrical connector 100 includes a cap 102 and a body 104. The body 104 may include a contact housing 108 having electrical contacts 110 (partially shown) secured in the contact housing 108, the contacts 110 having mounting ends 122 that extend from the contact housing 108 for electrical connection to the substrate 101. The electrical connector 100 with the FPC 106 received therein collectively defines a flexible printed circuit assembly 103.

The electrical connector 100 may carry electrical signals between the FPC 106 and the substrate 101. A good mechanical connection between the FPC 106 and the contacts 110 in the electrical connector 100 may improve the electrical connection. Insertion and retention of the FPC 106 in the electrical connector 100 may be desired before mounting the electrical connector 100 to a substrate 101. This may allow handling of the flexible printed circuit assembly 103, such as during manufacture or shipping, prior to attachment to the substrate 101. In addition, coupling the FPC 106 to the electrical connector 100 after the electrical connector 100 has been mounted on the substrate 101 may be difficult due to space constraints, such as limited space inside a computer chassis, for example.

Latching mechanisms may position the cap 102 on the body 104 such that different positions facilitate the insertion and retention of the FPC 106 in an opening 114 of the cap 102. Each latching mechanism may include a latching portion, such as latching portions 118*a*, 118*b* on the body 104, and a corresponding latching portion 119 on the cap 102. For example, a latching mechanism that holds the cap 102 on the body 104 may include a projection (shown by latching portion 118*a* or 118*b*) on the contact housing 108 and a slot (shown by latching portion 119) in a side wall 112*b* of the cap 102. When the cap 102 slides down on the body 104, each of the projecting latching portions 118*a* and 118*b* may be received by the slotted latching portion 119 to hold the cap 102 in respective latching positions on the body 104.

Mating ends (not shown) of the contacts 110 may extend upwards from the contact housing 108 for electrical connection to exposed conductive elements of the FPC 106 when a section of the FPC 106 is positioned in the contact housing 108 and maintained in connection therewith by the cap 102. The mating ends of the contacts 110 may wipingly connect to conductive elements on the surface of the FPC 106. The contacts 110 may be compression contacts, such that the contacts 110 deflect or compress when a force is exerted upon the mating ends, such as when the cap 102 is pushed on the body 104 and pushes against the mating ends.

The electrical connector 100 may be mounted on a substrate 101, such as a printed circuit board, for example. Mounting ends 122 of the contacts 110 may extend from the contact housing 108 for electrical connection to the substrate 101. The substrate 101 may have conductive elements. For example, a printed circuit board may have contact pads on the surface. The mounting ends 122 of the contacts 110 in the contact housing 108 may wipingly connect to the conductive elements on the substrate 101. If the contacts 110 are compression contacts, the contacts 110 may deflect or compress when a force is exerted upon the mounting ends 122, such as when the electrical connector 100 is secured to the substrate 101 and the substrate 101 pushes against the mounting ends 122.

Guide posts 120 may extend from the electrical connector 100. The guide posts 120 may aid in proper alignment of the electrical connector 100 on the substrate 101. The guide posts 120 may hold the electrical connector 100 in place on the substrate 101. The guide posts 120 may be of varying lengths and sizes to aid the alignment of or to hold the electrical connector 100 on the substrate 101. The cap 102 may have side walls such as 112*a*, 112*b*, and 112*c* that may provide alignment of the cap 102 as it is positioned on the body 104.

Figure 2:
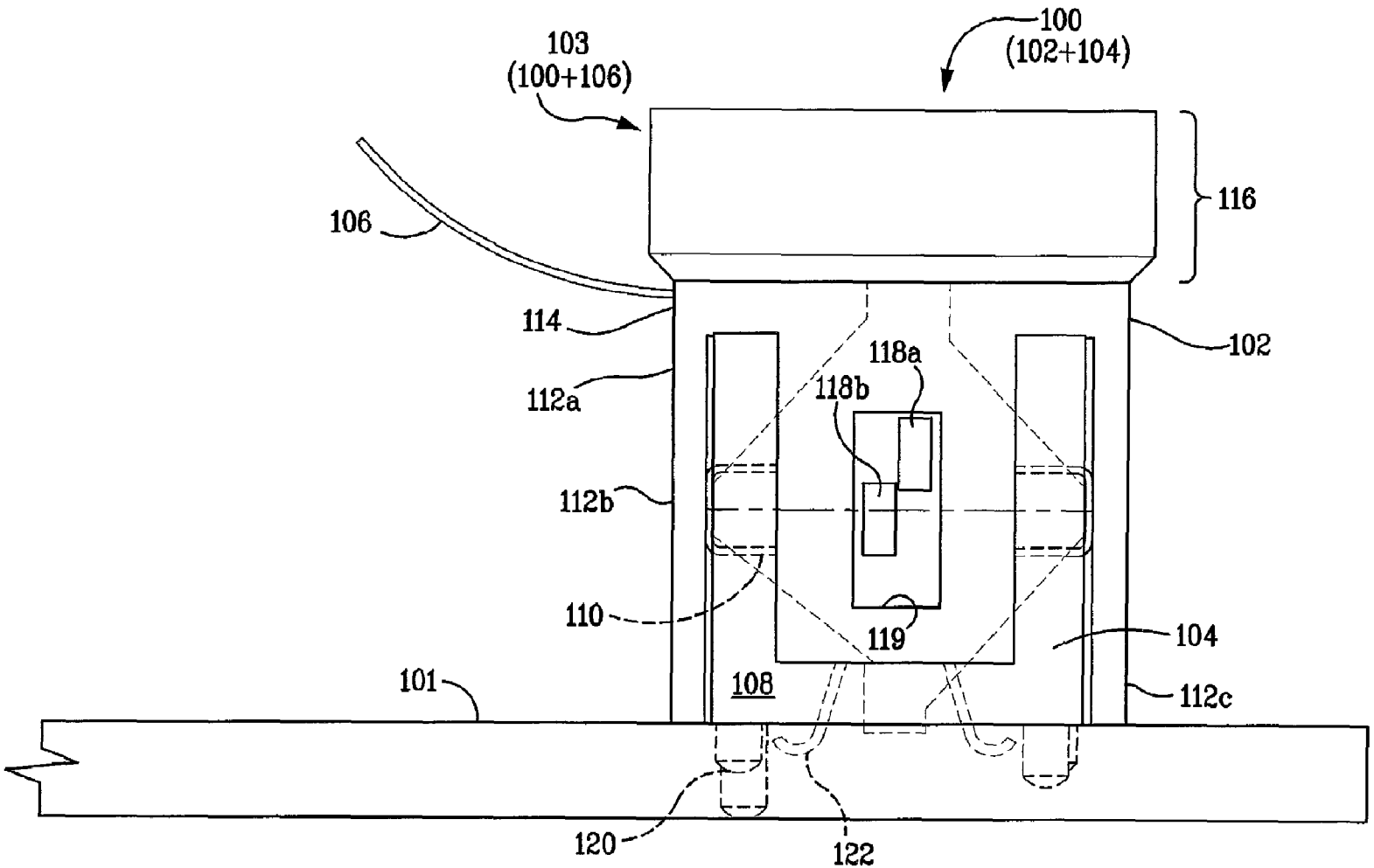
FIG. 2 depicts a side view of an example flexible printed circuit assembly mounted on a substrate.

FIG. 2 depicts a side view of the flexible printed circuit assembly 103 mounted on a substrate 101. The cap 102 may be depressed on the contact housing 108 and held in different positions on the body 104 via latching mechanisms. The latching mechanisms may be defined by corresponding latching portions, such as 118*a* and 119 or 118*b* and 119. As also shown in FIG. 1, the cap 102 may be in a position on the body 104 such that the FPC 106 inserted in the opening 114 is be held in place between the base 116 of the cap 102 and the body 104. A contact 110 in the contact housing 108 with mating ends that extend towards the FPC 106 may electrically connect with conductive elements on the FPC 106. The contact 110 may have mounting ends 122 that extend toward a substrate 101 and electrically connect with conductive elements on the substrate 101.

Figure 3:
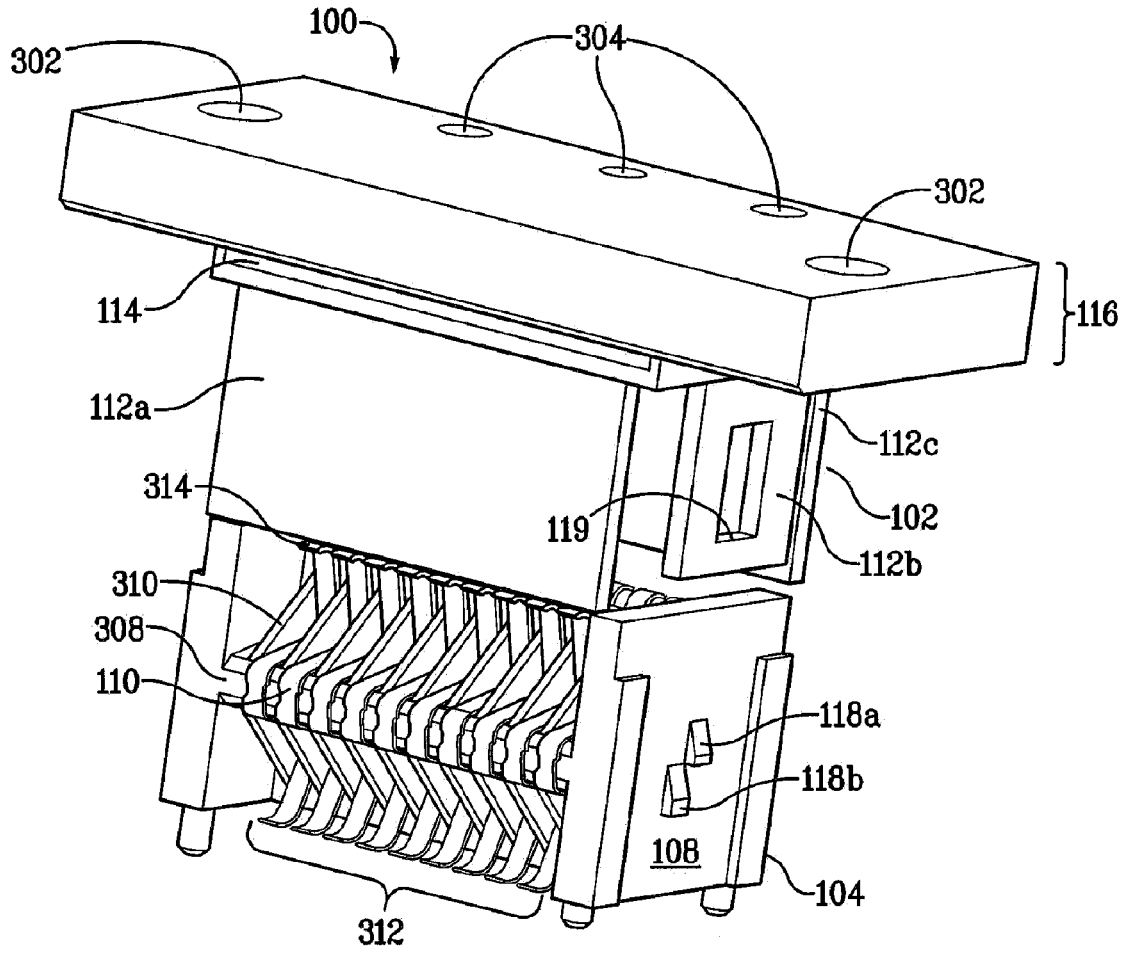
FIG. 3 depicts an exploded view of an example electrical connector including a cap and a contact housing.

FIG. 3 depicts an exploded view of the electrical connector 100 including the cap 102 and the body 104 before the cap 102 is depressed down on the body 104. An opening 114 may be defined by the cap 102. The face of the opening 114 may be defined by a side wall 112*a*. The top of the opening 114 may be defined by the base 116 of the cap 102. The opening 114 may extend through the cap 102 or it may extend only partway into cap 102. For example, a side wall 112*c* on the opposing side of the face of the opening 114 may prevent the opening 114 from extending through the cap 102. Therefore, an FPC 106 may be received in the opening 114 and extend through the cap 102 or it may extend partially into the cap 102 and be stopped by a formation in the cap 102. The bottom of the opening 114 may be formed such that the lower surface of the FPC 106 inserted in the opening 114 is adjacent to the body 104.

The cap 102 may have screw holes 302 and viewing holes 304. The leading edge of the FPC 106 may be viewed through viewing holes 304 in the cap 102 to ensure that the FPC 106 is sufficiently inserted. The electrical connector 100 may be mounted on a substrate 101, and then the electrical connector 100 may be further secured by screwing the electrical connector 100 into a mounting structure, such as a part of the chassis, for example, via a screw 402. A screw 402 may be inserted in a screw hole 302 in the cap 102 of the electrical connector 100, for example, and pass-through a hole in the substrate 101. The screw 402 may be screwed into any suitable mounting structure, such as a threaded boss located beneath the substrate 101.

Contacts 110 may be received in a contact housing 108. The contact housing 108 may include cavities 310 that may receive each electrical contact 110. The cavities 310 may be on both sides of the contact housing 108. Therefore, the contact housing 108 may include contacts 110 disposed in rows on opposing sides of the contact housing 108. The contacts 110 may be positioned adjacent to each other in each row and broadside to broadside to the contacts 110 in rows on the opposing side of the contact housing 108. A shelf portion 308 may be formed by the contact housing 108 on opposing sides of the contact housing 108. Contacts 110 may be shaped to fit over the shelf portion 308. For example, the shelf portion 308 may be U-shaped and the contacts 110 may be formed with a U-shaped mid-section that fits over the shelf portion 308. Contacts 110 may lock into place over the shelf portions 308 via locking mechanisms, as described in more detail herein.

The contact housing 108 may provide cavities 310 for locating the contacts 110 in a manner to form at least one array of contact ends positioned adjacent to each other (an example array is shown by 312). In this example electrical connector 100, the contact housing 108 provides two rows of contacts 110 that extend therethrough, where the contact ends extend upwards and downwards from the contact housing 108 and provide four arrays of contact ends. The two upper arrays may define a mating region and the two lower arrays (including example array 312) may define a mounting region.

Retaining the cap 102 in various positions on the contact housing 108 may aid in the insertion of the FPC 106 for a good electrical connection between conductive elements on the FPC 106 and the mating ends 314 of contacts 110 in the electrical connector 100. The electrical connector 100 may use a mechanism, such as a latching mechanism, to keep the cap 102 in the positions. An example method of assembling a flexible printed circuit assembly 103 using the latching mechanisms is shown in FIGS. 4A-4C.

Figure 4A:
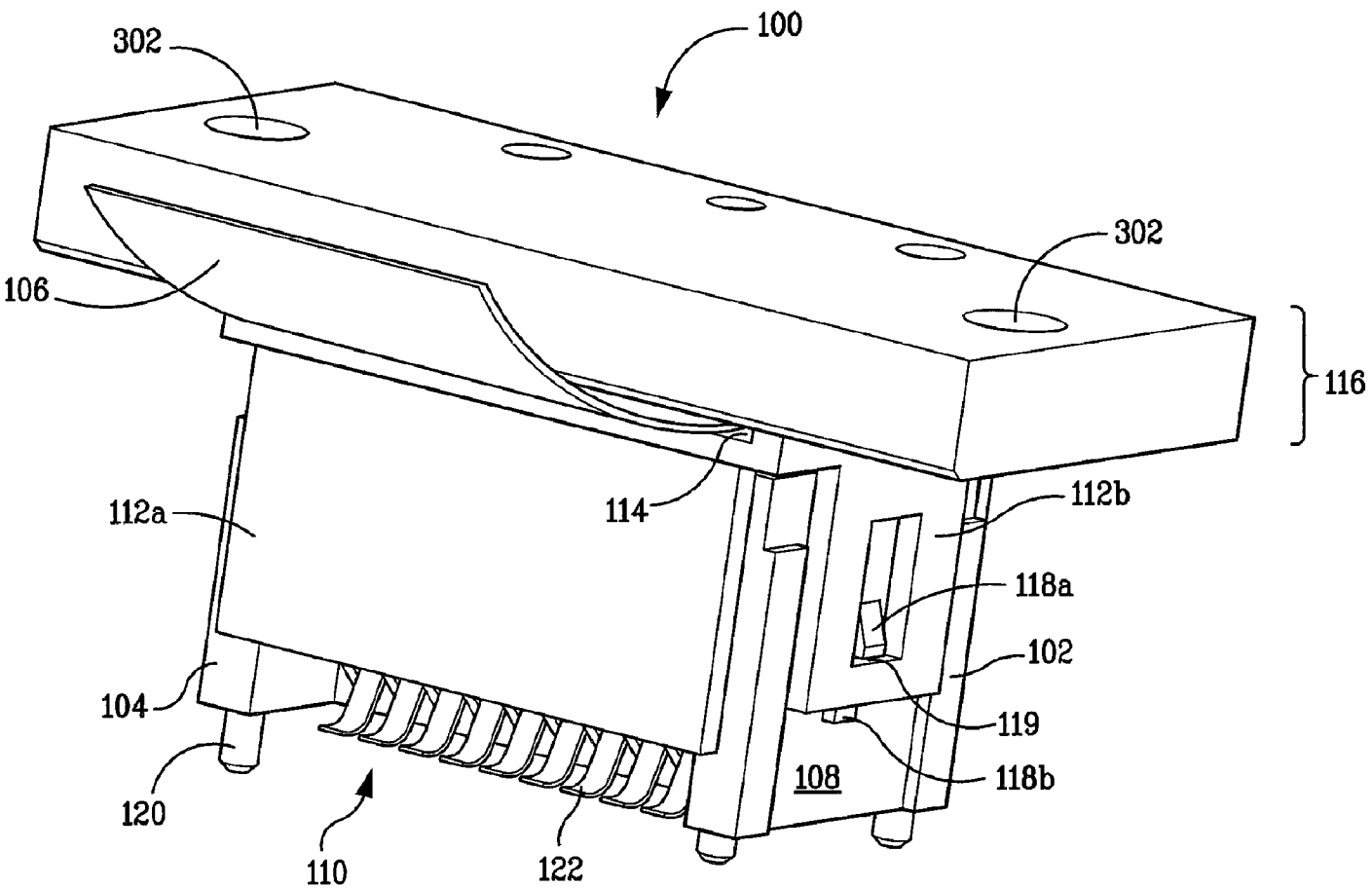
FIGS. 4A-4C depict an example sequence for assembling a flexible printed circuit assembly.
Figure 4B:
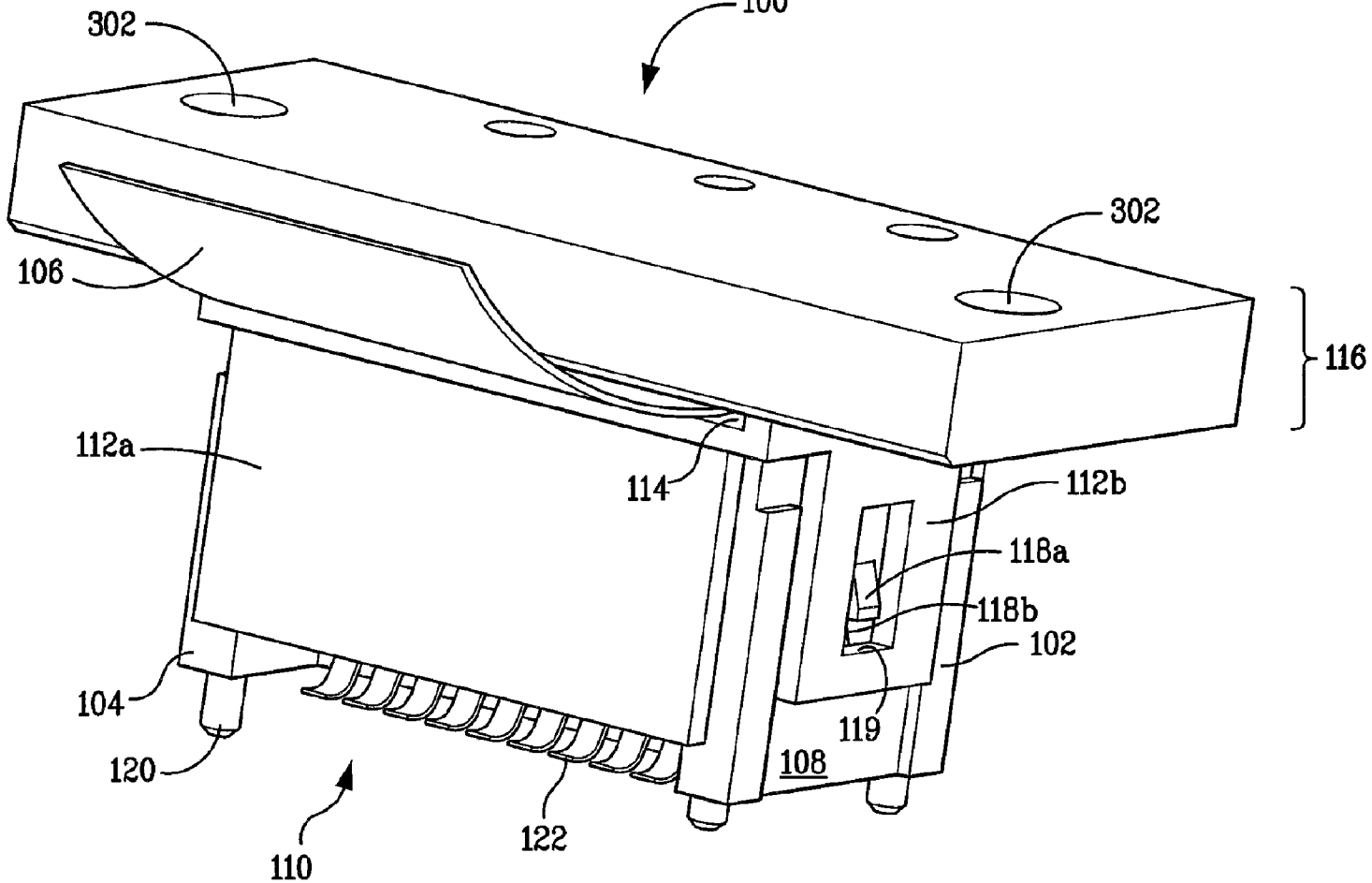
Figure 4C:
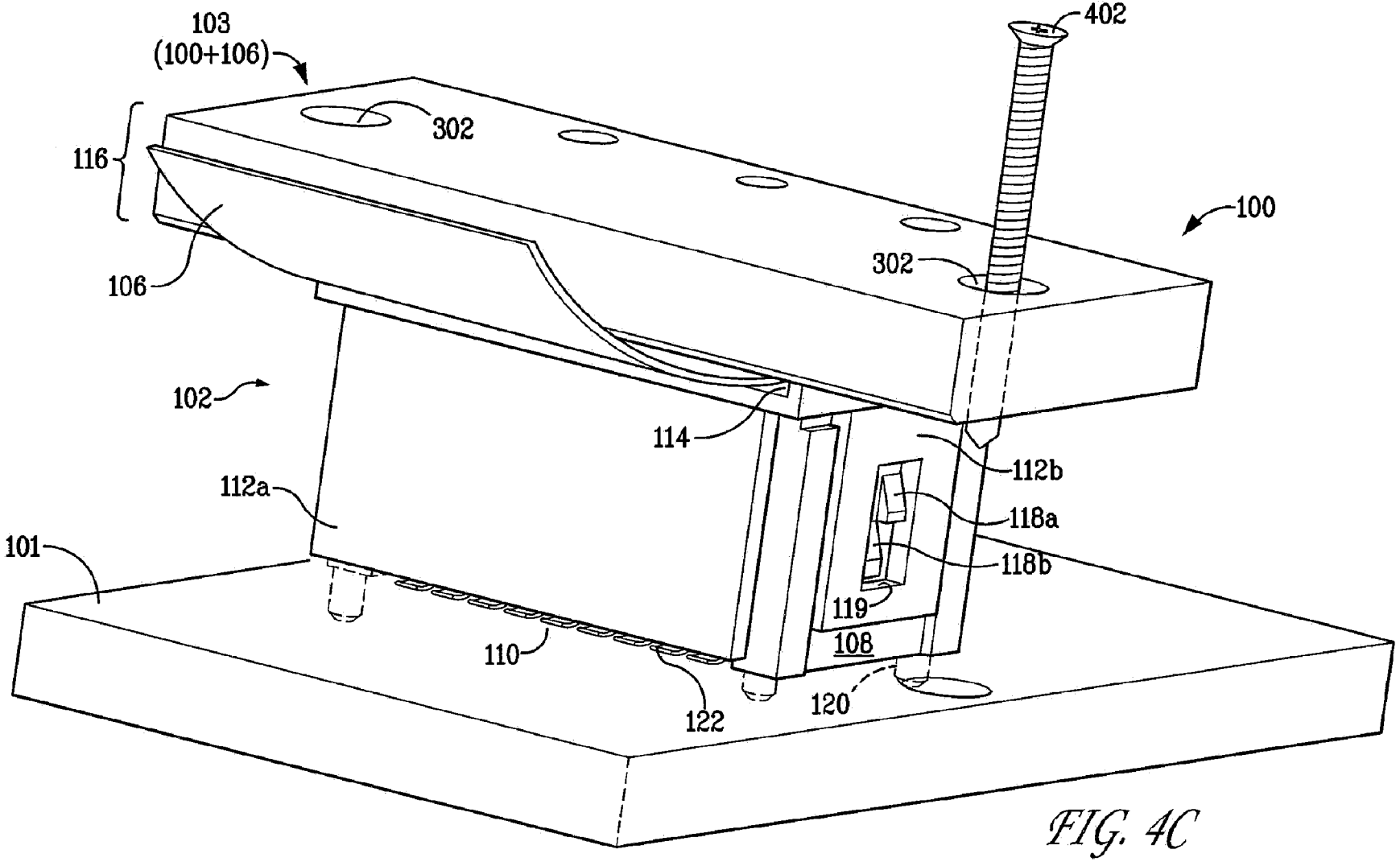

As shown in FIGS. 4A-4C, the latching mechanisms may each include multiple projections in the shape of sloping tabs (shown by latching portions 118*a* and 118*b*) on the contact housing 108. Each of the sloping tab latching portions 118*a*, 118*b* may correspond to a slot (shown by latching portion 119) in a flexible side wall 112*b* of the cap 102. The cap 102 may be depressed on the contact housing 108 into a first position as shown in FIG. 4A, where the flexible side wall 112*b* of the cap 102 slides over the first sloping tab latching portion 118*a*. The interior, bottom edge of the slotted latching portion 119 may be held underneath the tab to hold the cap 102 in place.

The cap 102 may be held on the body 104 in the first position shown in FIG. 4A such that the FPC 106 may be loosely inserted into the opening 114 in the cap 102. The leading edge of the FPC 106 may be viewed through viewing holes 304 in the cap 102 to ensure that the FPC 106 is sufficiently inserted. An end portion of the mating FPC 106 may be of a type having conductors exposed on the lower surface thereof. After insertion of the FPC 106 in the opening 114, one surface of the FPC 106 abuts the mating ends 314 of contacts 110 extending from the contact housing 108. The other surface of the FPC 106 abuts an edge of the cap 102, such as a surface of the base 116.

The cap 102 may be pushed down further on the contact housing 108 into a second position and held in place by another latching mechanism, as shown in FIG. 4B. For example, the slotted latching portion 119 in the side wall 112*b* may engage a second sloping tab latching portion 118*b* that projects from the contact housing 108. In the second position, the FPC 106 that was loosely inserted in the opening 114 of the cap 102 in FIG. 4A may be compressed between a base 116 of the cap 102 and an edge of the contact housing 108. The second position may result in a force between the FPC 106 and the contacts 110 that are housed in the contact housing 108. If the contacts 110 are compression contacts, the compression force imparted onto the FPC 106 by the mating ends 314 of the contacts 110 may hold the FPC 106 in place. The force of the second position may secure the FPC 106 in the electrical connector 100 through the rest of the assembly process. The FPC 106 may be held in the cap 102 such that a pulling force on the FPC 106 in a direction opposite to the direction of insertion does not pull the FPC 106 from the electrical connector 100.

The electrical connector 100 may then be mounted on the substrate 101 in FIG. 4C, such as by inserting the guide posts 120 into corresponding holes on the substrate 101. The guide posts 120 may aid in proper alignment of the electrical connector 100 on the substrate 101. The guide posts 120 may hold the electrical connector 100 in place on the substrate 101. Further, a screw 402 may be inserted through the cap or body, passed through a hole in the substrate 101, and screwed into a suitable mounting structure (not shown).

The FPC 106 is shown in FIG. 4C, which would have been inserted in the first position of FIG. 4A. A screw 402 may be inserted in a screw hole 302 in the cap 102 of the electrical connector 100, for example. Screwing the electrical connector 100 into a suitable mounting structure may further drive the cap 102 on the body 104 beyond the second latching position into a third position. Thus, the distance between the base of the cap 102 and the substrate 101 in the second latching position may be greater than the distance between the base of the cap 102 and the substrate 101 in the third position, because in the third position the cap 102 is pressed further on the body 104 (beyond the second latching position). The attachment may further tighten the connection between the FPC 106 and the mating ends 314 of the contacts 110. The attachment may also further tighten the connection between the substrate 101 and the mounting ends 122 of the contacts 110. The latch mechanisms may no longer be important once the connector is attached to the substrate 101 in such a manner.

Various latching mechanisms may be employed to hold the cap 102 in place on the body 104. For example, as shown in FIGS. 4A-4C, a slotted latching portion 119 in a side wall 112*b* that extends from the base 116 may define one of the latching portions, and the slot may correspond to latching portions 118*a*, 118*b* on the contact housing 108. In another embodiment, a side wall 112*a*, 112*b* may have projections that are received by slots formed in the contact housing 108. In another embodiment, legs formed from the cap 102 may extend from the base 116 of the cap 102 and may be received into cavities molded from the contact housing 108. Legs of the cap 102 may have tabs that may be received by slots of the contact housing 108, retaining the cap 102 in the slots in the contact housing 108 as the cap 102 is depressed down on the body 104. Any suitable latching mechanism that holds the cap 102 on the body 104 may be employed.

A single latching portion on either the cap 102 or the body 104 may engage with multiple latching portions on the other one of the cap 102 or body 104 to hold the cap 102 in different positions. For example, the example connector in FIG. 4A-4C has multiple projections 118*a*, 118*b* on the contact housing 108 that define multiple latching portions 118*a*, 118*b* on the contact housing 108. A slotted latching portion 119 in a flexible side wall 112*b* of the cap 102 defines a singe latching portion 119 on the cap 102 that corresponds to the multiple latching portions 118*a*, 118*b*. In another example, the multiple latching portions may be on the cap 102, each corresponding to a single latching portion on the body 104 to hold the cap 102 in different positions.

When the cap 102 is depressed on the contact housing 108, the mating ends 314 of the contacts 110 may extend upwards from the contact housing 108 and be pressed into the FPC 106. The base 116 of the cap 102 may be rigid and not allow for upward movement of the FPC 106 in the opening 114, so the mating ends 314 of the contacts 110 press into the FPC 106. The mating ends 314 may wipe against contact pads disposed on the FPC 106. If the mating ends 314 are compressive, they may be resiliently displaced and pushed against the contact pads. The force may help to stably hold the FPC 106.

Figure 5:
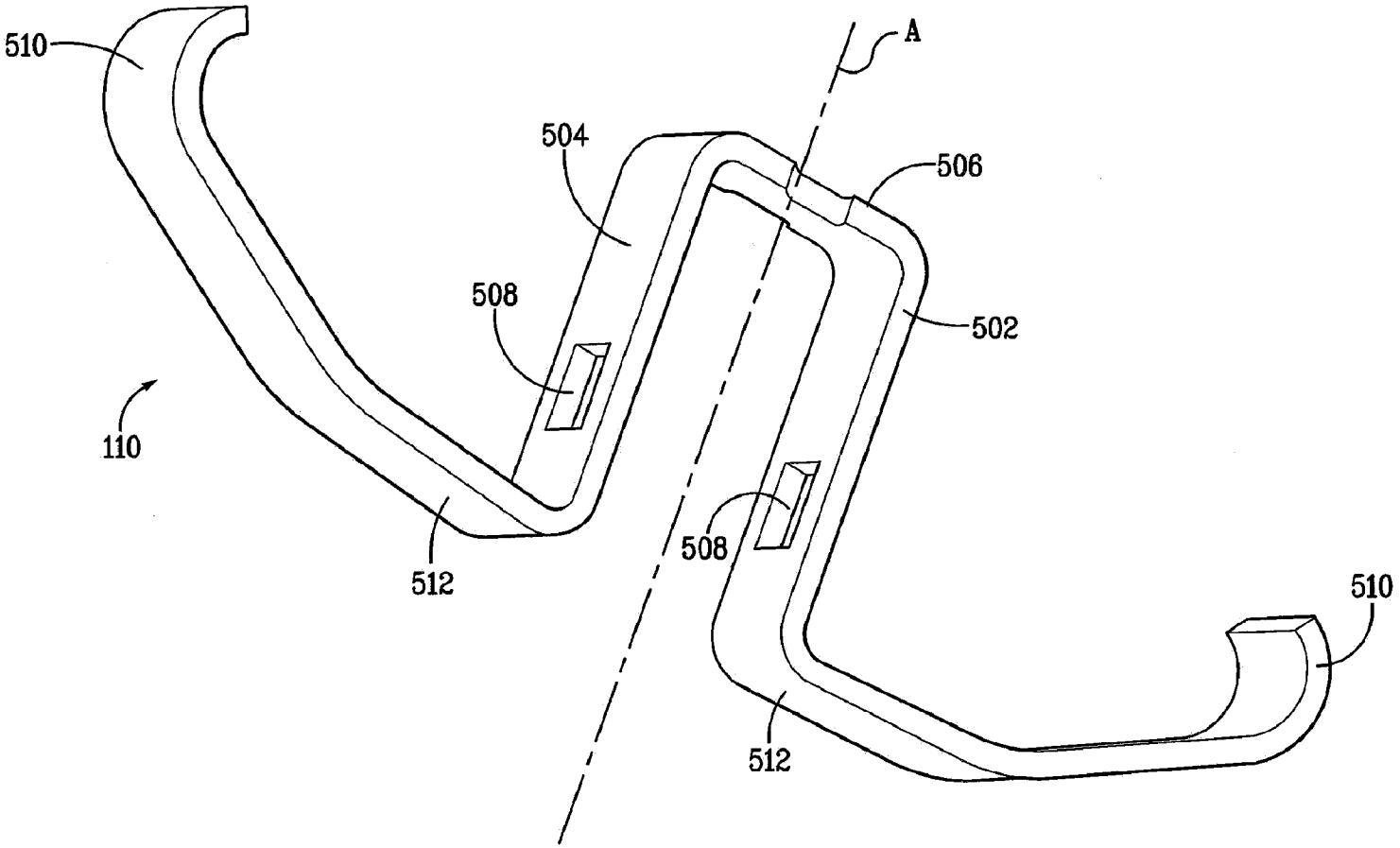
FIG. 5 depicts an example contact that may be contained in an electrical connector.

The contacts 110 housed in the contact housing 108 may have a suitable geometry for compression. FIG. 5 depicts an example contact 110 that is a compression contact. The compression contact 110 may include a first portion 502 and a second portion 504 that may extend from a base portion 506. For example, the first portion 502 and a second portion 504 may extend at their first ends from a base portion 506. The first and second portions 502, 504, may each include a compression member 512 which may extend from a second end of the first and second portions 502, 504. The compression members 512 may be straight or may include multiple segments that are connected at various angles. The compression members 512 may terminate in a curved segment 510 that curves toward the base portion 506. The contact 110 may be symmetrical about an axis A defined by the base portion 506 as shown.

The shape formed by the base portion 506, first portion 502, and second portion 504 may be such that the contact 110 may be received into a contact housing 108, such as the contact housing 108 in FIG. 3. For example, the shelf portion 308 shown in FIG. 3 may project in a U-shape. The first portion 502 of the contact 110 may be substantially parallel to the second portion 504 such that the first portion 502, second portion 504, and base portion 506 form a U-shape. The contact 110 may be received into the cavities 310 of the contact housing 108 and fit over the U-shaped shelf portion 308.

The contact housing 108 and contacts 110 may include locking mechanisms to hold the contacts 110 in place. For example, contact locking sections 508 may be disposed on the first and second portions 502, 504, of the contact 110. The shelf portion 308 shown in FIG. 3 may include a housing locking section (not shown) that engages the locking sections 508 of the contact 110. When the contact 110 is fit over the shelf portion 308 of the contact housing 108, the contact locking section 508 may be engaged with a housing locking section such that the contact 110 is locked into place. The locking sections 508 on the contact 110 shown in FIG. 5 include a slot in each of the first and second portions 502, 504.

Figure 6B:
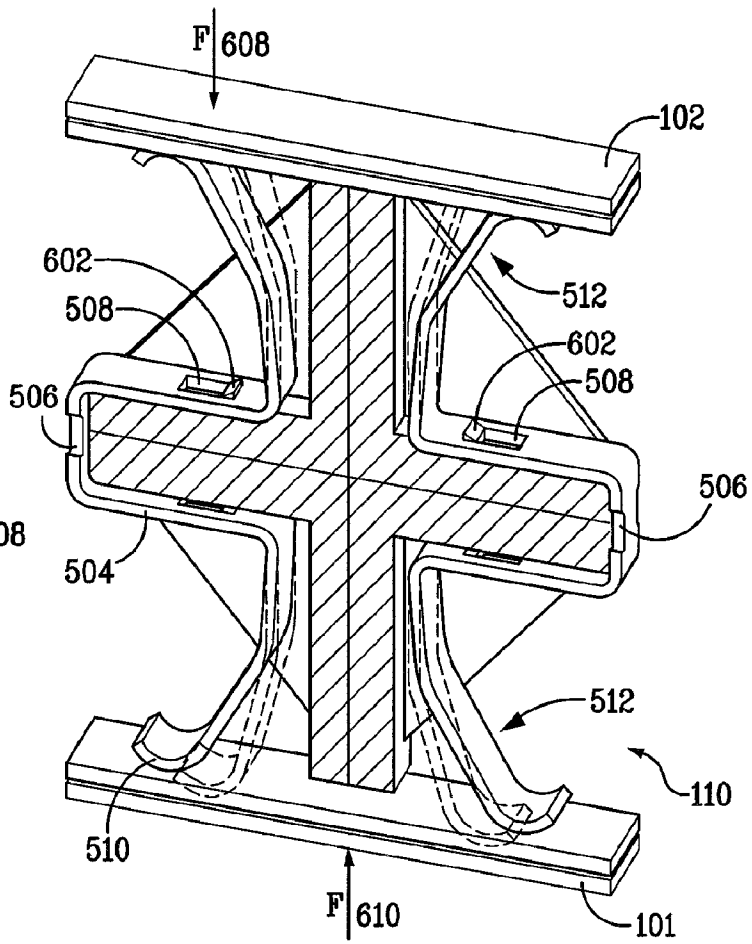
FIG. 6A depicts a cut away side view and FIG. 6B depicts a cross-sectional view of a contact housing with the example contact of FIG. 5 received therein.
Figure 6A:
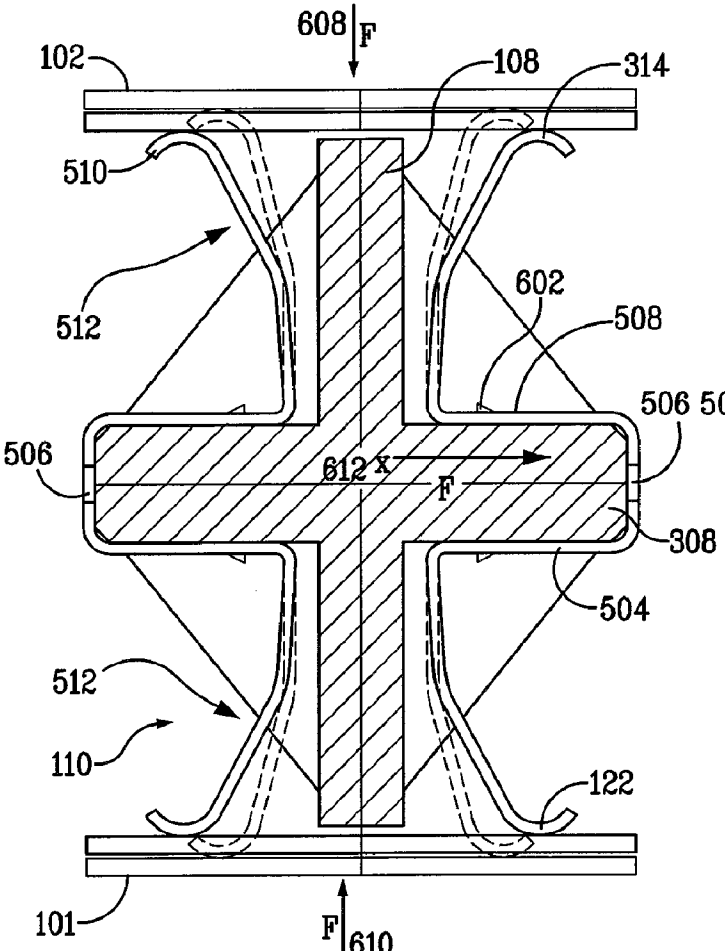

If a force acts on a compression member 512, the respective compression member 512 may be resiliently displaced towards the base portion 506. Thus, the force acting on the compression member 512 causes the compression member 512 to deflect towards the base portion. The displacement may be dependent on the amount of force acting on the compression member 512 and where on the compression member 512 the force is applied. FIGS. 6A and 6B depict an example of the compression that may result when a force acts upon the compression members 512. The force 608 acting on the mating ends 314 of the example contact 110 may be a result of the cap 102 depressing down on the contact housing 108 that contains the contacts 110. A force 610 acting on the mounting ends 122 of the example contact 110 may be a result of the connector being mounted on the substrate 101, where the connector is pushed down onto or screwed onto a mounting structure. The displacement of the terminals of the compression members 512 from their resting position in this example is 0.25 mm.

An initial force 608 or 610 acting on the compression members 512 may cause a resulting force 612. The resulting force 612 may be along the direction of the first or second portions 502, 504 in a first direction. Without the locking mechanism, the force may be sufficient to push the contact 110 off of the U-shaped shelf portion 308 out of the contact housing 108. A contact locking section 508 may be disposed on the contact 110 and a corresponding contact housing locking section 602 may be disposed on the contact housing 108. The direction of the resulting force 612 may serve to further engage the locking sections 508, 602. For example, a locking section 508 on the contact 110 may be a slotted locking section 508 (as shown in FIG. 5) that receives a projection locking section 602 disposed on the contact housing 108. A force 608 may act on the compression member 512 and result in a force 612 acting on the first or second portion 502, 504, in a first direction towards the base portion 506. The first or second portion 502, 504 of the contact 110 may be pushed in the direction of the force 612. This force 612 further presses the slotted locking section 508 against the projection locking section 602, further engaging the locking sections 508 and 602 and holding the contact 110 securely in the contact housing 108.

Mating ends 314 of the contacts 110 may deflect or compress when a force 608 is exerted upon them, such as when a cap 102 is pushed over a contact housing 108 and pushes against the mating ends 314 that extend from the contact housing 108. Mounting ends 122 of the contacts 110 may extend from the contact housing 108 in a direction different than the mating ends 314. The mounting ends 122 of the contacts 110 may correspond to a rigid structure, such as a rigid printed circuit board. As a cap 102 is depressed on the contact housing 108, the mounting ends 122 may also compress or deflect to be suitably biased against conductive elements of the rigid structure.

The shape of the first and second portions 502, 504, and the base portion 506 may provide sufficient resilience for separate movement of the upper and lower contact regions. For example, a force 608 acting on the mating ends 314 may not cause compression or displacement of the mounting ends 122. Likewise, a force 610 acting on the mounting ends 122 may cause compression of the mounting ends 122 that does not cause compression or displacement of the mating ends 314.

Figure 7A:
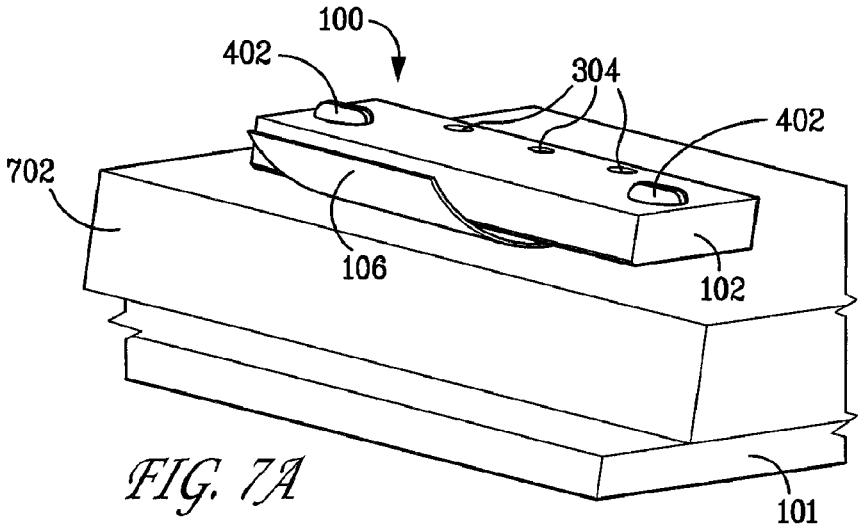
FIGS. 7A-7C depict an electrical connector that is mounted on a substrate, with a base plate disposed between the connector and substrate.

An electrical connector such as that described herein may pass through a base plate and mount on a substrate. For example, FIG. 7A depicts an electrical connector 100 with a base plate 702 disposed between the cap 102 of the electrical connector 100 and the substrate 101. A intervening base plate 702 may be made of metal, for example, and may provide more stability for mounting the electrical connector 100 to a substrate 101. For example, the base plate 702 may be a metal framework of a disc drive.

Figure 7B:
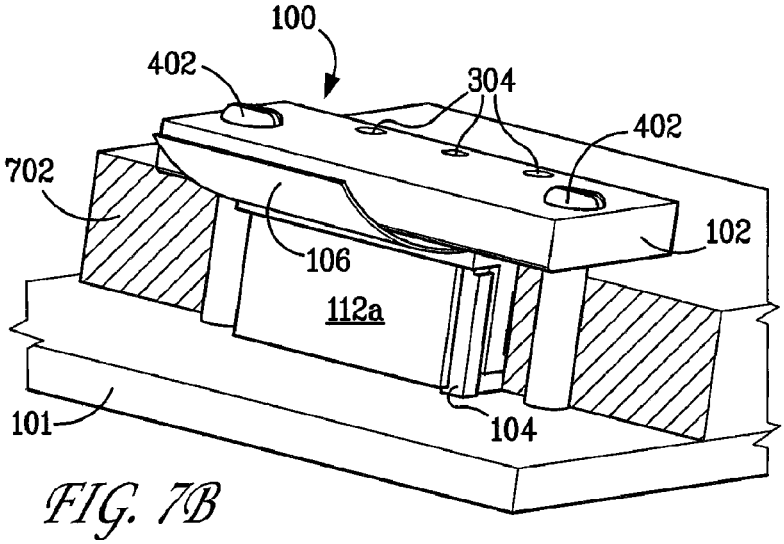

FIG. 7B depicts a cross-section of the base plate 702, with the electrical connector 100 extending therethrough and mounting on the substrate 101. The base plate 702 may include an insertion space formed such that the electrical connector 100 can pass through the base plate 702 and mount onto the substrate 101. The cap 102 width may be wider than the insertion space, such that a portion of the cap 102 is above the base plate 702 or rests on a surface of the base plate 702. The base plate 702 may also include insertion spaces such that screws 402 may be inserted into the cap 102 of the connector 100. The screws 402 may extend through the base plate 702 and the substrate 101 and screw into a mounting structure below the substrate 101, further securing the base plate 702 in the disposed position between the cap 102 and the substrate 101. The electrical connector 100 may be mounted onto the substrate 101 via guide posts 120 (not shown) to hold the electrical connector 100 in place on the substrate 101. The base plate 702 disposed between the cap 102 and the substrate 101 may provide additional stability for mounting the electrical connector 100 on the substrate 101, the base plate adapted to further securing the connector 100 in place on the substrate 101.

Figure 7C:
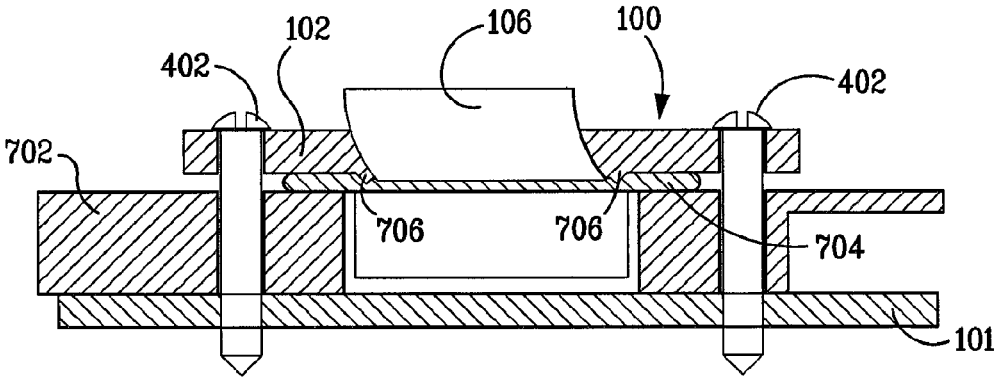

Often, an electrical connector 100 is located in places that are subject to gases and/or liquids. The electrical connector 100 may include a sealing surface such that at least a portion of the electrical connector 100 may seal to another surface to create a barrier from undesirable substances, such as certain gases or liquids, for example. FIG. 7C depicts a cross section of an example electrical connector 100 mounted on a substrate 101 with a base plate 702 disposed between, with a seal 704 on the cap 102 of the electrical connector 100. When the electrical connector 100 is inserted through the base plate 702 and mounted on the substrate 101, the seal 704 on the underside of the cap 102 may compress against another surface, such as the base plate 702 adjacent to the seal 704. The seal 704 may be a gasket made of rubber, for example, or any other resilient material. When the cap 102 is pressed towards the base plate 702, the seal 704 may compress between the cap 102 and the base plate 702. For example, the seal 704 may seal to a base plate 702, such as a metal framework of a disc drive, wherein the substrate 101 is located underneath the base plate 702. When pressure is applied on a seal 704 that is uniformly distributed between the cap 102 and base plate 702, an airtight seal may be achieved.

An FPC 106 may be received by the electrical connector 100 such that a portion of the FPC 106 extends between the cap 102 and the seal 704, as depicted in FIG. 7C. When the FPC 106 is positioned between the cap 102 and the seal 704, a non-uniform distribution of the seal 704 may result such that upon compression of the seal 704 with the FPC 106 in place, small tapered voids result at the edges of the FPC 106. Various embodiments of the electrical connector as described herein may include a seal 704 that provides for better compression around a portion of an FPC 106 that is between the cap 102 and the seal 704. FIG. 7C depicts an example embodiment with protrusions 706 on the cap 102. The resilient seal 704 may abut the portion of the cap 102 with the cap protrusions 706. When the seal 704 is compressed, such as when the cap 102 is pressed against the base plate 702, the protrusions 706 may force or compress more of the seal 704 into the voids that would otherwise result at the edges of the FPC 106. Thus, a better seal may be achieved.

In another embodiment, a pre-formed portion on the seal 704 may define a gap for which the FPC 106 may be inserted. The gap may be formed to correspond to the shape of the FPC 106. Thus, when the FPC 106 is inserted into an opening 114 in the electrical connector 100, the FPC 106 may first be inserted through a gap between the cap 102 and the seal 704, where the gap is result of the pre-formed portion of the seal 704. The pre-formed portion may be tailored to the shape of the FPC 106 to reduce the amount of redistribution of the seal necessary to fill in around the edges of the FPC 106, thereby reducing voids adjacent to the FPC 106 that may result upon compression. For example, the pre-formed portion may be a cut out in the seal 704 that closely matches the height and width of the FPC 106. When the seal is compressed with the FPC 106 that is positioned in the pre-formed portion, the seal may not require as much redistribution for the seal to fit compress around the FPC 106 because the pre-formed portion better accommodates the FPC 106 that extends from the electrical connector. In another example embodiment, the pre-formed portion may be a distribution of the seal 704 such that the seal 704 that abuts the FPC 106 is thinner and more resilient, thus enabling the seal 704 to redistribute with more flexibility around the FPC 106.

The FPC 106 is shown in FIG. 7C between the seal 704 and the cap 102 of the electrical connector 100. However, the FPC 106 may also extend from the electrical connector 100 such that the FPC 106 is not between the cap 102 and the seal 704, but rather extends from the connector 100 below the seal, where an upper surface of the FPC 106 is adjacent to the seal 704. The FPC 106 may then be positioned between the seal 704 and another surface, such as a base plate 702. As described herein, protrusions 706 on the cap 102 or a pre-formed section on the seal 704 may provide for better compression and therefore provide a better seal between the electrical connector 100 and another surface.

Figure 8A:
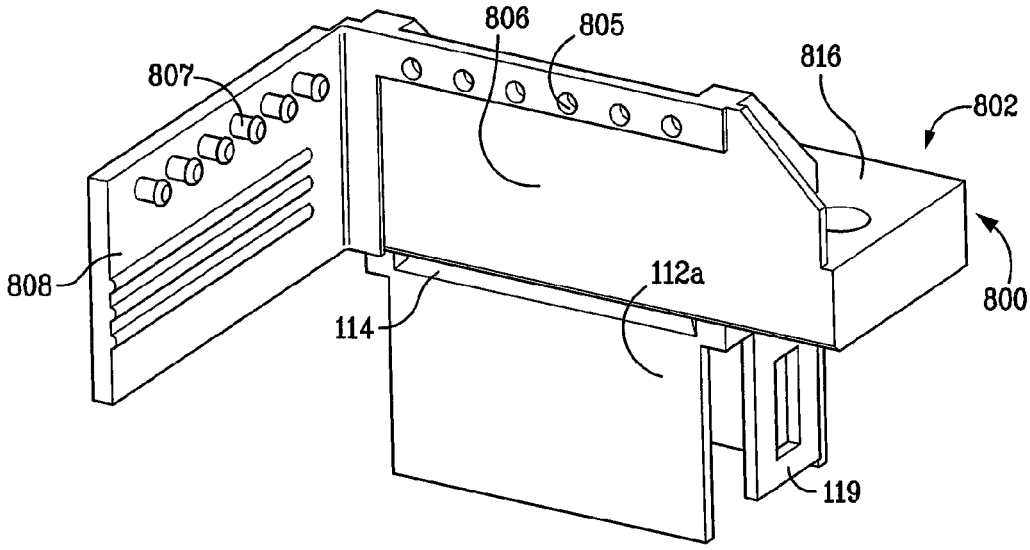
FIGS. 8A-8C depict an example sequence for assembling a flexible printed circuit assembly, the electrical connector having a hinged cap.
Figure 8B:
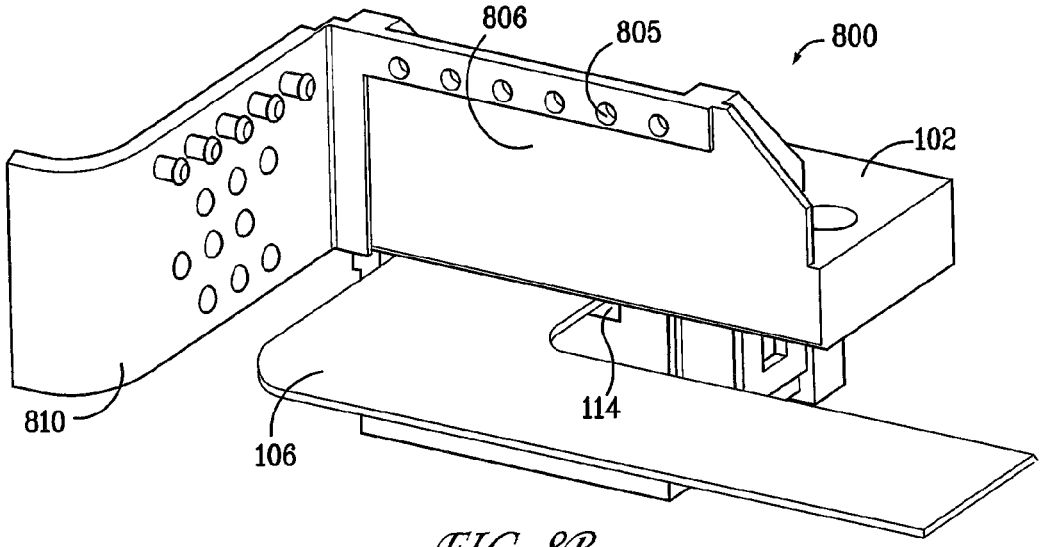

Various embodiments of an electrical connector 100 as described herein may include latching mechanisms to hold a cap of the connector over a body and/or a sealing surface that provides suitable compression. FIG. 8A depicts an electrical connector that utilizes latching mechanisms to hold a cap in various positions on the body as described herein. The electrical connector 800 further includes a first wall 806 that extends from or includes a portion of the base 816 of the cap 802. FIGS. 8A and 8B each depict an example second wall 808, 810 that may be attached to the first wall 806. The second wall 808, 810 may be attached to the first wall 806, such as by a hinge, such that the second wall 808, 810 may be closed and secured to the first wall 806. The second wall 808, 810 may be secured to the first wall 806 by any method, such as the example shown with fitting pegs 807 on wall 808, 810 into holes 805 in the first wall 806.

Figure 8C:
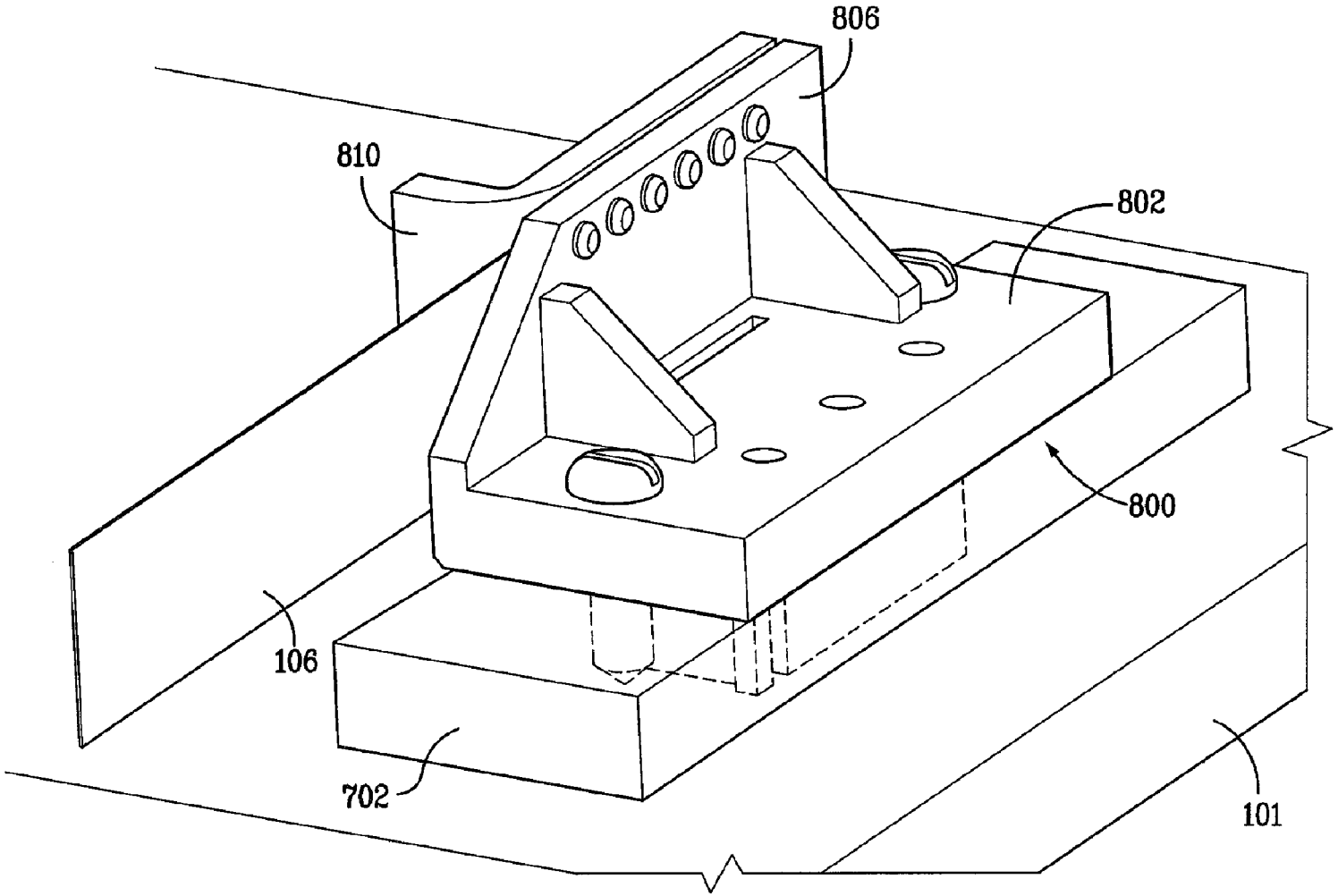

As depicted in FIG. 8B, a portion of the FPC 106 may extend from the portion of the FPC 106 that is received by the cap 802. FIG. 8B shows connector 800 with a second wall 810 that may be attached to the first wall 806. This portion of the FPC 106 may be folded up and secured between the first and second walls 806, 810, as shown in FIG. 8C. Securing the FPC 106 between the walls 806 and 808 or 810, in this manner may provide strain relief by absorbing forces of push and pull that may act on the FPC 106. This cap design 802 may allow the FPC 106 that hangs out of the electrical connector 800 to move without breaking away from the electrical connector 800 and allows flexibility in the FPC 106 without putting stress on a vulnerable part of the FPC 106 that extends from the electrical connector 800. As shown in FIG. 8C, the electrical connector 800 may pass through a base plate 702 and be mounted on a substrate 101. The electrical connector 800 may include a sealing surface (not shown), as described herein, such that at least a portion of the electrical connector 800 may seal to another surface to create a barrier from undesirable substances, such as certain gases or liquids, for example.

Figure 9A:
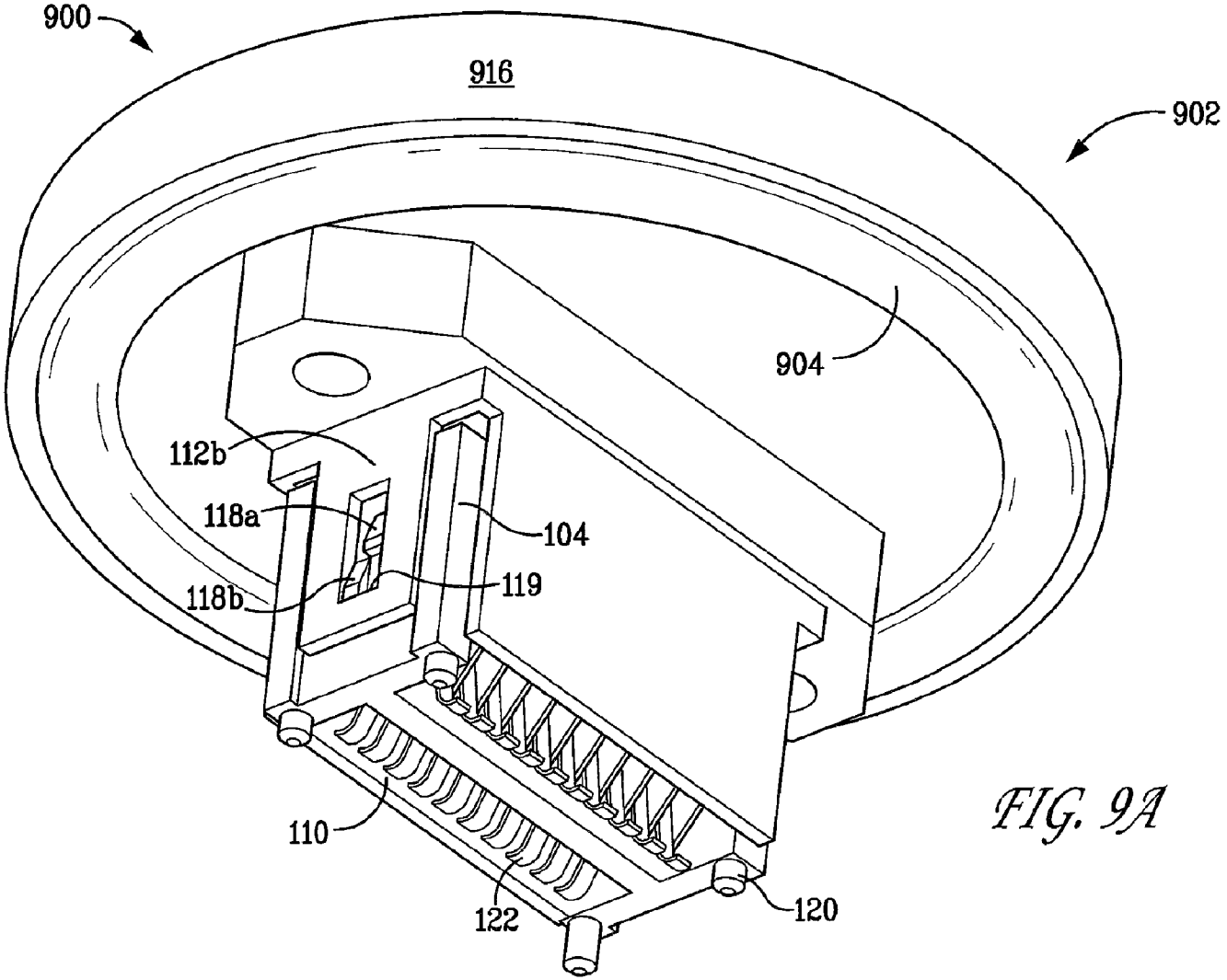
FIGS. 9A and 9B depict an example electrical connector with a disk-shaped cap.
Figure 9B:
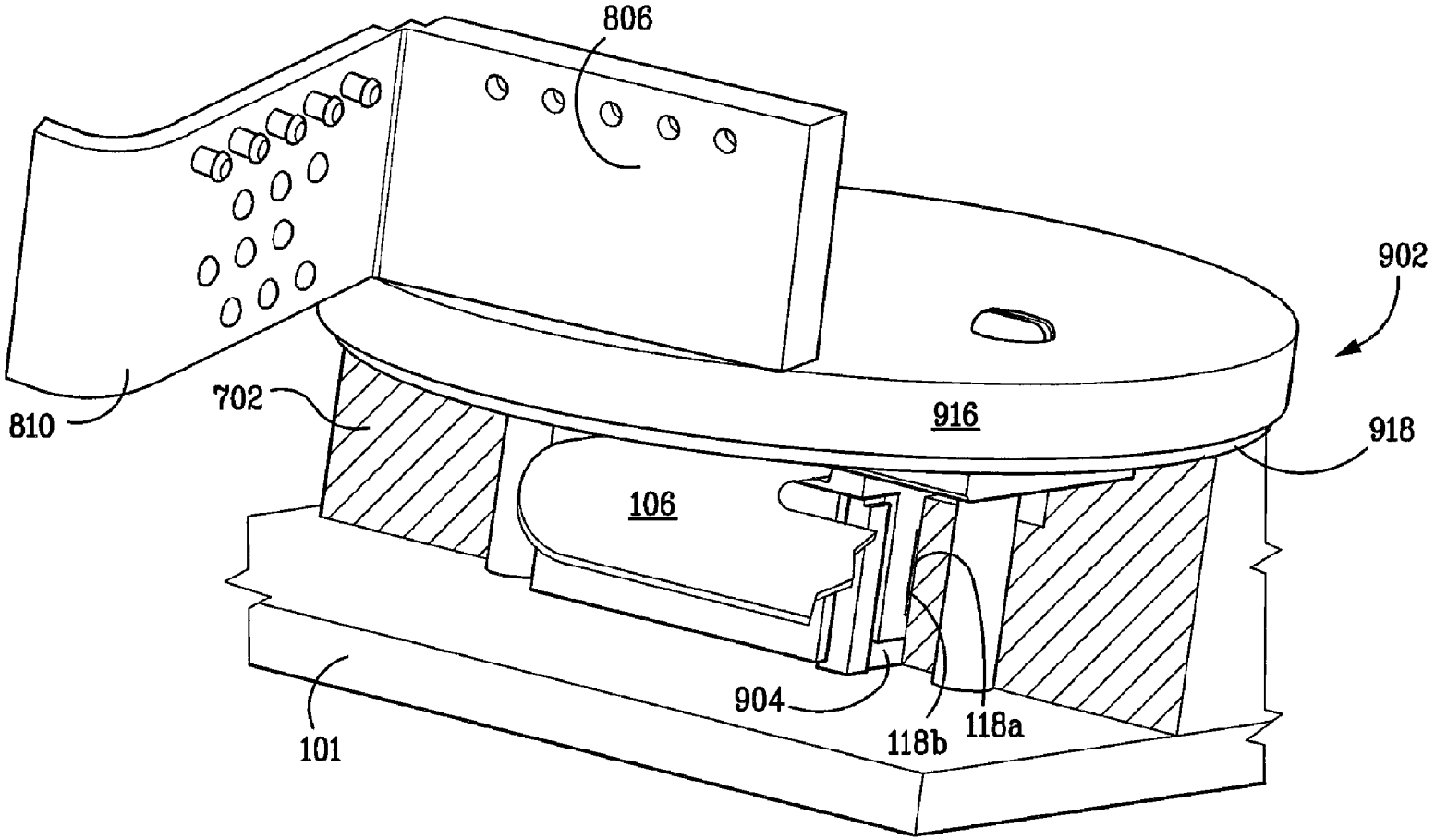

Another example connector that may receive an FPC 106 and utilizes both latching mechanisms to hold a cap in various positions over the body and a sealing surface is shown in FIG. 9A. The electrical connector 900 may include an extended base 916 of a cap 902, where the base 916 is formed into a disc-shape. The cap 902 may include a sealing edge 904. The sealing edge 904 may be on a surface of the base 916. When the electrical connector 900 is mounted on a substrate 101 as shown in FIG. 9B, the sealing edge 904 may abut a base plate 702 disposed between the connector 100 and the substrate 101, or it may directly abut the surface of the substrate 101. The sealing edge 904 may be a resilient seal 904 as described herein, such that the seal 904 of an electrical connector 100 with an FPC 106 received may provide suitable compression for a substantially airtight enclosure. This sealing may keep gases or fluids from leaking into or out of the sealed surface.

FIG. 9B depicts an electrical connector 900 that further encompasses several of the example embodiments disclosed herein. For example, the electrical connector 900 includes a disc-shaped cap 902, a hinged lid with parts 806 and 808, a base plate 702 (shown in cross-section) disposed between the cap 902 and a substrate 101 that the electrical connector 900 is mounted to, latching portions 118*a* and 118*b* for positioning the cap 902 over the body 904, and a sealing surface 918 that is adapted to prevent contact with undesirable substances.

What is claimed:

1. An electrical connector comprising:

a body with a contact housing and at least one contact at least in part received in the contact housing;

a cap defining an opening adapted to receive a flexible printed circuit;

a plurality of latching mechanisms, wherein a first latching mechanism of the plurality of latching mechanisms adapted to position the cap relative to the body in a first position, and a second latching mechanism of the plurality of latching mechanisms adapted to position the cap relative to the body in a second position, said first position being different from said second position, wherein said second latching mechanism is adapted to retain the cap relative to the body in the second position such that a flexible printed circuit received in the opening is held in the electrical connector.

2. An electrical connector of claim 1, wherein the plurality of latching mechanisms each includes a plurality of latching portions on the cap that corresponds to a respective latching portion on the body.

3. An electrical connector of claim 1, wherein the first latching mechanism is adapted to retain the cap on the body in a position such that a flex printed circuit is loosely held in the electrical connector.

4. An electrical connector of claim 1, wherein the cap is adapted to be placed in a third position relative to the body when the electrical connector is mounted on a substrate, wherein a first distance is defined between a base of the cap and the substrate in the second position, and a second distance is defined between the base of the cap and the substrate in the third position, wherein said second distance is less than said first distance.

5. An electrical connector of claim 1, wherein a base of the cap comprises a sealing surface adapted to abut a substrate.

6. An electrical connector of claim 1, further comprising:

a first wall that extends from a base of the cap; and a second wall movably attached to the first wall, wherein the first and second walls are adapted to hold a portion of a flexible printed circuit extending from the electrical connector between the first and second walls.

7. An electrical connector of claim 1, wherein at least one of the plurality of latching mechanisms is defined by at least one latching portion on the cap and at least one corresponding latching portion on the body.

8. An electrical connector of claim 7, wherein at least one of the plurality of latching mechanisms includes a projection and a slot that is adapted to receive the projection.

9. The electrical connector of claim 1, wherein the at least one contact comprises:

a base portion;

a first portion extending from the base portion and having a first compression member;

a second portion extending from the base portion and having a second compression member, wherein the first portion comprises a contact locking section that is adapted to engage with a housing locking section of the contact housing, and wherein the contact is adapted such that when a force acts on the contact, the contact locking section is adapted to further engage the housing locking section, and a segment of the first portion extending from the base portion to the locking section remains uncompressed.

10. The compression contact of claim 9, wherein the force acting on the compression contact is a resulting force acting on the first portion of the contact and is the result of an initial force acting on at least one of the first or second compression member.

11. The compression contact of claim 9, wherein the force acting on the compression contact causes the first compression member to deflect towards the base portion.

12. The compression contact of claim 9, wherein the first portion comprises a plurality of segments, wherein at least one segment is connected to another segment by an angle.

13. The compression contact of claim 9, wherein the contact locking section of the first portion is at least one of the following: a slot that is adapted to receive a projection on the contact housing or a projection that is adapted to be received by a slot on the contact housing.

14. A flexible printed circuit assembly comprising:

an electrical connector adapted to receive a flexible printed circuit, the electrical connector comprising:

a body;

a contact at least partially received in the body;

a cap positioned on the body;

a plurality of latching mechanisms, wherein each of the plurality of latching mechanisms is adapted to retain the cap on the body in a respective position; and a flexible printed circuit, wherein the flexible printed circuit is received in the electrical connector, and wherein at least one of the plurality of latching mechanisms is adapted to retain the cap on the body in a position such that a flexible printed circuit is held between the cap and the body.

15. A flexible printed circuit assembly of claim 14, further comprising:

a first wall that extends from a base of the cap; and a second wall movably attached to the first wall, wherein the first and second walls are adapted to hold a portion of a flexible printed circuit extending from the electrical connector between the first and second walls.

16. An electrical connector comprising:

at least one electrical contact;

a body;

a cap positioned on the body and defining:

a base, a first wall that extends from the base, and a second wall movably attached to the first wall, wherein the electrical connector is adapted to receive a first portion of a flexible printed circuit between the cap and the body and wherein the first and second walls are adapted to provide strain relief to the flexible printed circuit by holding a second portion of the flexible printed circuit that extends from the electrical connector between the first and second walls.

17. A flexible printed circuit assembly of claim 16, wherein the second wall is movably attached to the first wall by a hinge.

18. A method for assembling a flexible printed circuit assembly, the method comprising:

positioning a cap on a body in a first position, wherein said cap defines an opening, and a first latching mechanism retains the cap on the body in said first position;

inserting a flexible printed circuit loosely in the opening defined by the cap, wherein a surface of the flexible printed circuit received is adjacent to the body; and positioning the cap on the body into a second position, wherein the flexible printed circuit is held in place between the cap and the body in the second position, and a second latching mechanism retains the cap on the body in the second position.

19. The method of claim 18, wherein the body contains a plurality of contacts, each contact defining a mating region, and the mating region is adapted to electrically connect to the surface of the flexible printed circuit that is adjacent to the body.

20. A contact housing comprising compression contacts, the contact housing comprising:

U-shaped portions that are projected in a first and second row on opposing sides of the contact housing and are adapted to receive a plurality of compression contacts formed to fit over the U-shaped portions, wherein a plurality of locking sections are disposed on parallel posts of the U-shaped portions; and a plurality of compression contacts positioned broadside to broadside in cavities in the first and second rows, wherein each of said plurality of compression contacts comprises:

a first portion having a compression segment; and a contact locking section that corresponds to a housing locking section on the U-shaped portions;

wherein the locking sections are adapted to retain each of the compression contacts in the contact housing and are adapted such that a force acting upon the compression segment further engages the locking sections.

21. An electrical connector comprising a body having at least one contact at least in part received in the body;

a cap positioned over the body, wherein a portion of the cap comprises a protrusion;

a resilient seal at least in part abutting the cap protrusion, the seal adapted to compress between the cap and an opposing surface, wherein the electrical connector is adapted to receive a flexible printed circuit between the cap and the resilient seal such that a portion of the flexible printed circuit extending from the connector abuts the resilient seal, and the cap protrusion compresses the seal towards space adjacent to the flexible printed circuit.

* * * * *